US006547576B2

(12) United States Patent
Peng et al.

(10) Patent No.: US 6,547,576 B2
(45) Date of Patent: Apr. 15, 2003

(54) POWER SOURCE CONNECTOR ASSEMBLY FOR AN EXTRACTABLE HARD DRIVE BOX

(75) Inventors: Cheng-Tzu Peng, Chupei (TW); Chuan-Yi Yeh, Hsinchu (TW)

(73) Assignee: Promise Technology Inc., Hsinchu (TW)

( * ) Notice: Subject to any disclaimer, the term of this patent is extended or adjusted under 35 U.S.C. 154(b) by 0 days.

(21) Appl. No.: 10/197,897

(22) Filed: Jul. 19, 2002

(65) Prior Publication Data

US 2003/0054696 A1 Mar. 20, 2003

Related U.S. Application Data

(63) Continuation-in-part of application No. 09/953,274, filed on Sep. 17, 2001, now abandoned.

(51) Int. Cl.[7] ..... H01R 29/00
(52) U.S. Cl. ..... 439/173
(58) Field of Search ..... 439/540.1, 954, 439/171, 173, 928.1, 640; 361/685

(56) References Cited

U.S. PATENT DOCUMENTS 4,861,281 A * 8/1989 Warner ..... 439/540.1
5,076,802 A * 12/1991 Colleran et al. ..... 439/468
5,145,411 A * 9/1992 Pastal et al. ..... 439/598
5,609,500 A * 3/1997 Holmes et al. ..... 439/540.1
5,827,088 A * 10/1998 Weatherley ..... 439/532
6,077,113 A * 6/2000 Lecomte ..... 439/471
6,178,106 B1 * 1/2001 Umemoto et al. ..... 363/146
6,341,060 B1 * 1/2002 Chuang ..... 248/27.1
6,347,715 B1 * 2/2002 Drozdenko et al. ..... 211/26
6,354,888 B1 * 3/2002 Cech et al. ..... 439/532

* cited by examiner

*Primary Examiner*—Tulsidas Patel
*Assistant Examiner*—Phuong Dinh
(74) *Attorney, Agent, or Firm*—Rabin & Berdo, P.C.

(57) ABSTRACT

A power source connector holder for an extractable hard drive box includes a plastic block and sliding slots. A groove is formed on the top surface of the plastic block, and an elastic leaf is disposed in the groove. The elastic leaf has one end fixed to an inner wall of the groove, and has a bump at the other end. The power source connector holder is combined to a connector supporting element with a sliding track and two positioning recesses. The power source connector holder is slidable along the sliding track from a first position of the bump engaged with one positioning recess to a second position engaged with the other positioning recess so as to be adjustable with respect to a position of the power source connector of different hard drives.

5 Claims, 6 Drawing Sheets

POWER SOURCE CONNECTOR ASSEMBLY FOR AN EXTRACTABLE HARD DRIVE BOX

This application is a Continuation-In-Part of patent application, Series No. 09/953,274, filed on Sep. 17, 2001 now abandoned.

BACKGROUND OF THE INVENTION

The present invention is related to an improved power source connecting holder for hard disc extraction box wherein the power source connecting holder is adjustable response to the different positions of the power source connector of the hard disc.

The conventional hard disc extraction boxes now on sale and in use have the following drawbacks:

Since the hard discs made by various manufacturers are different from each other, and the difference consists in the position where the power source connector of hard disc is disposed but the power source connecting holder of hard disc extraction box cannot be adjustable in full response to the different hard discs.

In view of the foregoing drawbacks, the present inventor developed the present invention in the light of his experiences in designing the products concerned.

SUMMARY OF THE INVENTION

The primary object of present invention is to offer an improved power source connecting holder for hard disc extraction box wherein the power source connecting holder can be desirably adjustable in response to the different positions of power source connector of the hard disc.

BRIEF DESCRIPTION OF THE DRAWINGS

The primary object, characteristics and functions of the present invention can best described in conjunction with the following drawings.

DETAILED DESCRIPTION OF PREFERRED J.EMBODIMENT

Figure 1:
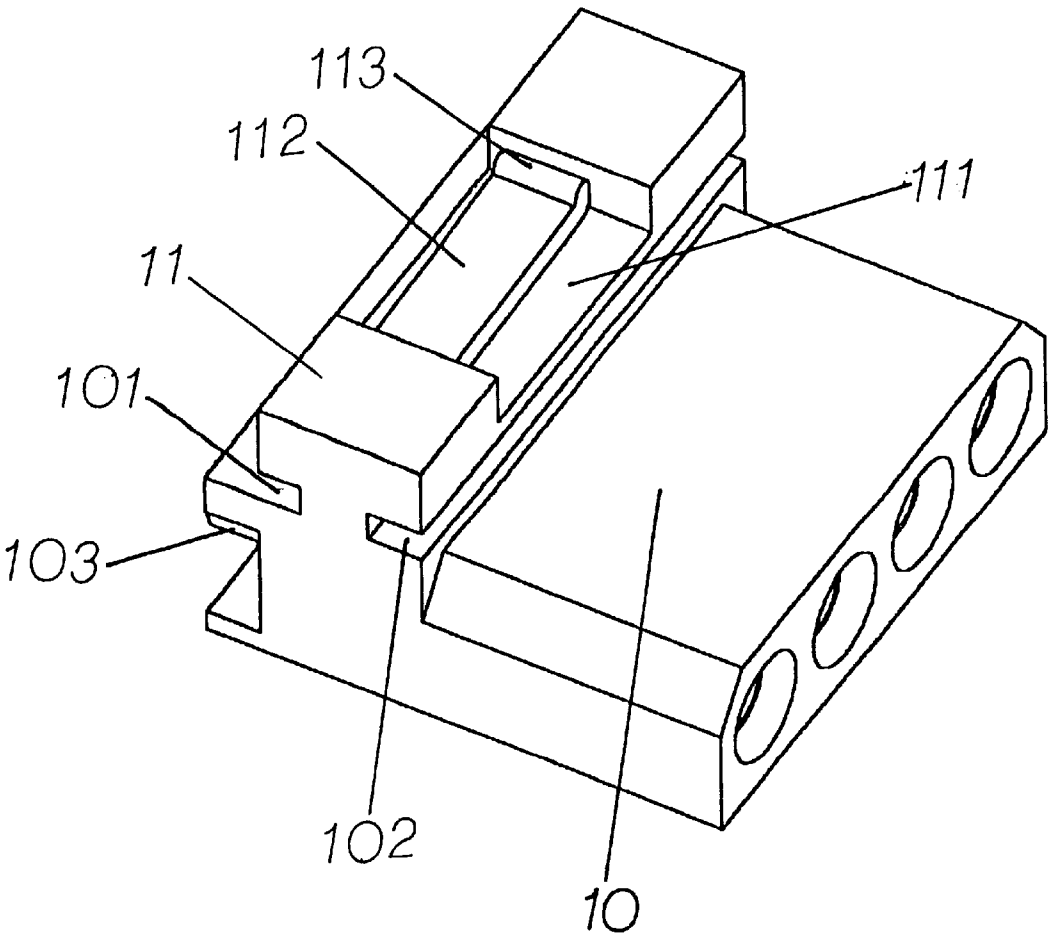
FIG. 1 is an appearance view of the present invention.

As shown in FIG. 1, a plastic block (11) is set on a power source connecting holder (10), two slide track slots (101), (102) are disposed between the power source connecting holder (10) and the plastic block (11), a fillister (111) is set on the top side of the plastic block (11), a spring leaf (112) is disposed on the upper edge of an inner wall of the fillister (111); the spring leaf (112) with elasticity is made of plastic, and a convex block (113) is set at one end of the spring leaf (112); the convex block (113) is in the shape of a semicircular are and can be inserted in two positioning slots (204*a*, 204*b*) so as to fix the power source connecting holder (10) which will not slide therefore.

Figure 2:
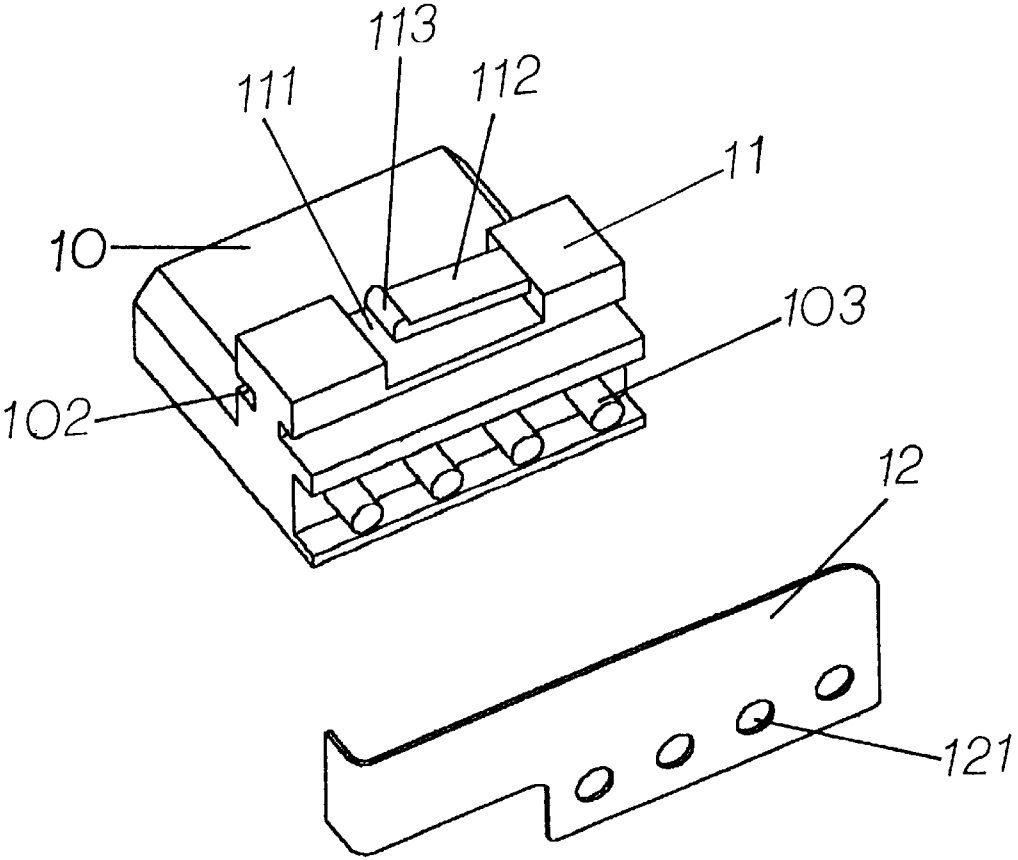
FIG. 2 is a breakdown view of the present invention and soft bank wire.
Figure 3:
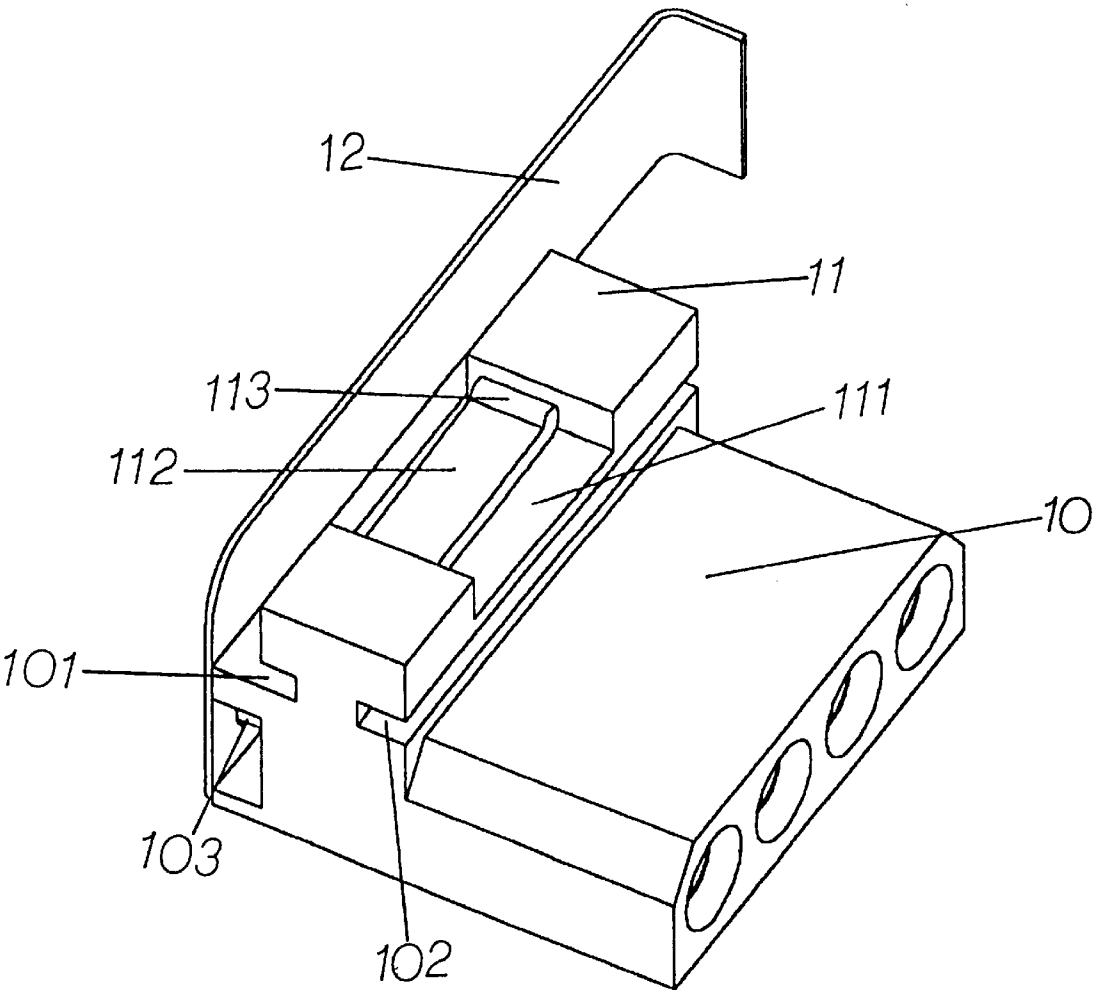
FIG. 3 is an assembly view of the present invention and soft bank wire.

As shown in FIGS. 2 and 3, a soft bank wire (12) substitutes for the conventional power source transmission line for current transmission, and four connecting holes (121) are set on the soft bank wire (12) for connecting a connecting leg (103) of the power source connecting holder (10).

Figure 4:
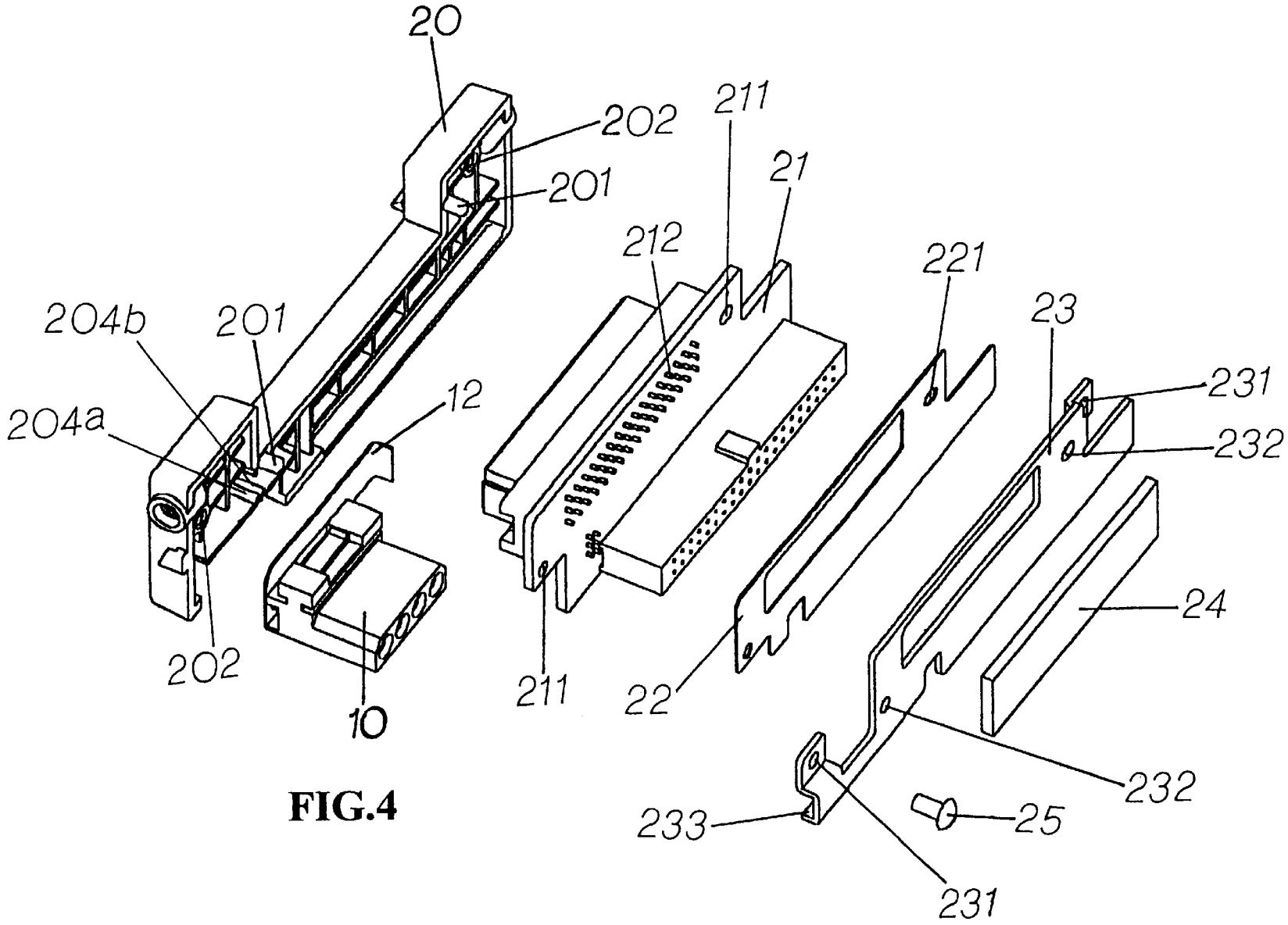
FIG. 4 is a breakdown view of the present invention and connector support assembly.
Figure 6:
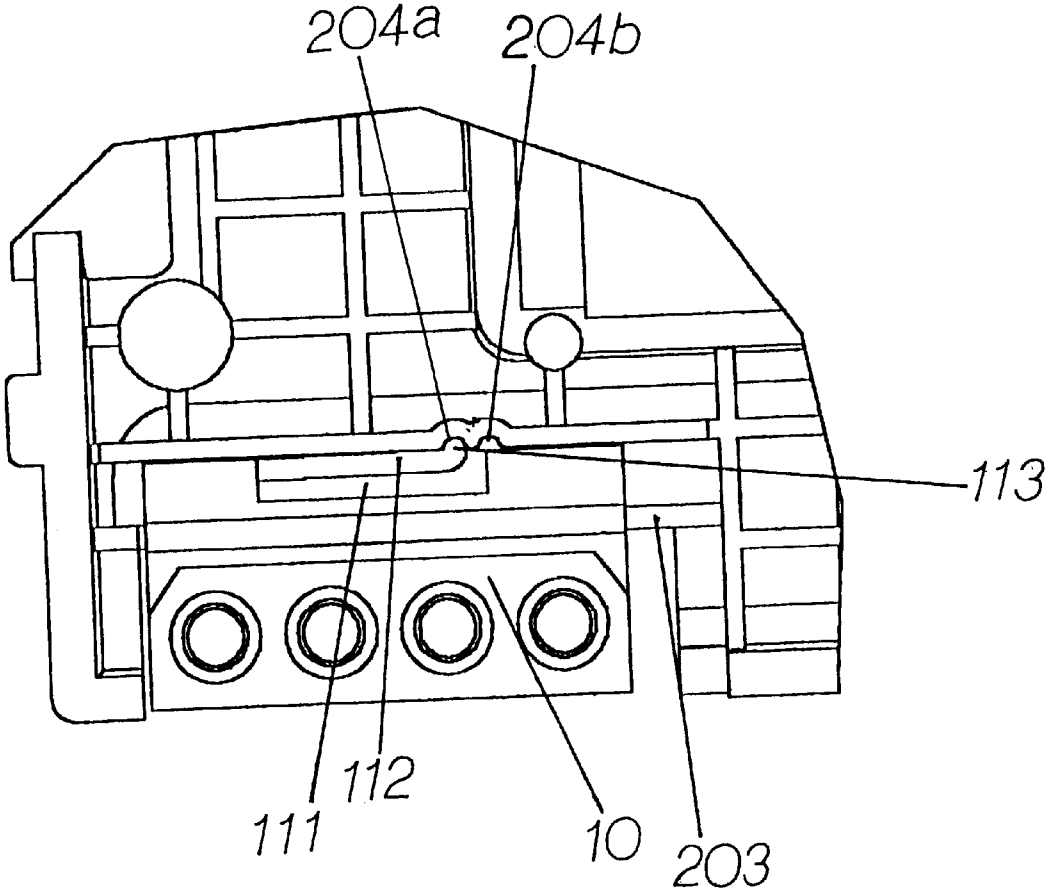
FIG. 6 is a front section view of the connector support of the present invention.

As shown in FIGS. 4 and 6, a fixing bolt (201), a screw hole (202), a slide track (203) and two positioning slots (204*a*, 204*b*) are disposed on the back side of a connector support (20); the fixing bolt (201) is designed to fix an article with a bolt hole to be applied over the fixing bolt (201); the screw hole (202) is designed to lock a screw (25) and to insert the slide track (203) in the slide track slot (101) of the power source connecting holder (10) which can slide therein; the positioning slots (204*a*, 204*b*) are disposed on the top side of slide track (203) so as to catch the convex block (113) in place.

As shown in FIG. 4, one each bolt hole (211) is disposed on the left and right sides of the panel of a printed circuit board component (21) to be applied over the fixing bolt (201) which will not move therefore; and similarly, one each bolt hole (221) is disposed on the left and right sides of an insulating piece (22) to be applied over the fixing bolt (201) so as to fix the insulating piece (22) on the connector support (20). One each screw hole (231) and one each bolt hole (232) are disposed on the left and right sides of a metal fixing piece (23), and a slide track (233) is disposed below the screw hole (231) which is designed to lock a screw (25) and further to fix the metal fixing piece (23) whereon the bolt hole (232) is applied over the fixing bolt (201) so as to fix the metal fixing piece (23) on the connector support (20); the slide track (233) on the metal fixing piece (23) is to be inserted in the slide track slot (102) of power source connecting holder (10) which can slide on the slide track (233). A pin leg protecting cover (24) is designed to protect a pin leg (212) on the printed circuit board component (21) so as to avoid the pin leg (212) from suffering damage or to avoid the user from suffering hurt by the pin leg (212).

Figure 5:
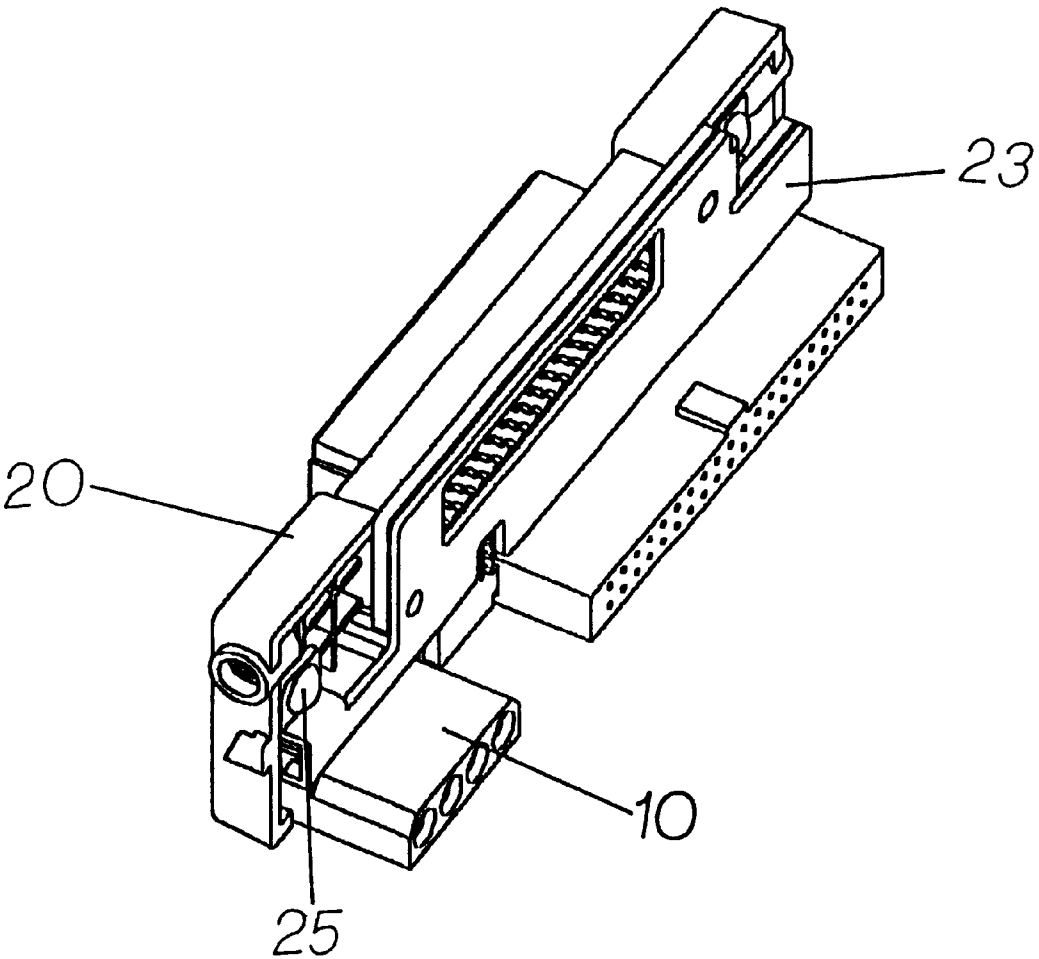
FIG. 5 is an assembly view of the present invention and connector support assembly.

As shown in FIGS. 4 to 6, let the slide track slot (101) of power source connecting holder (10) correspond to the slide track (203) on the connector support (20) so as to insert the slide track (203) in the slide track slot (101) and install the power source connecting holder (10) on the connector support (20); next, the printed circuit board component (21) and isulating piece (22) are applied over the fixing bolt (201) on the connector support (20) by means of the bolt holes (211,221) in sequence and then overlapped on and connected to the connector support (20). The screw hole (231) and bolt hole (232) on the metal fixing piece (23) correspond to the fixing bolt (201) and screw hole (202) of connector support (20) and then overlap on and connect to the insulating piece (22), the slide track (233) of metal fixing piece (23) will insert in the slide track slot (102) of power source connecting holder (10). Then let two screws (25) correspond to the screw holes (231) of metal fixing piece (23) respectively and lock in the screw holes (231) of metal fixing piece (23) so as to tightly fix the printed circuit board component (21) and insulating piece (22).

As shown in FIG. 3 and 4 after the power source connecting holder (10) and the connector support (20) assemble with each other, the connecting hole (121) of soft bank wire (12) is connected to the connecting leg (103) of power source connecting holder (10).

As shown in FIG. 6, when the power source connecting holder (10) slides rightward, the convex block (113) and the inner wall of positioning slot (204*a*) will squeeze each other, the spring leaf (112) will bend toward the bottom of fillister (111), the power source connecting holder (10) will slide rightward; and when the convex block (113) moves from one positioning slot (204*a*) to another positioning slot (204*b*), the spring leaf (112) will restore its own original state because of its own elasticity, and the convex block (113) will insert in the positioning slot (204*b*).

We claim:

1. A power source connector assembly, comprising:

a power source connector holder including a plastic block having a groove, an elastic leaf having one end mounted to a wall defining the groove and another end having a bump, a first sliding slot, and a second sliding slot;

a connector supporting element including a first sliding track for slidingly engaging the first sliding slot, and two positioning recesses for selectively engaging the bump; and a fixing piece including a second sliding track for slidingly engaging the second sliding slot, the power source connector holder being positioned between the connector supporting element and the fixing piece, and is laterally slidable from a first position where the bump engages with one of the positioning recesses to a second position where the bump engages with the other one of the positioning recesses wherein, when the power source connector holder is laterally slid, the first and the second sliding tracks slide within the first and the second sliding slots, respectively, so that a position of the power source connector holder is adjustable to allow connection of a power source connector from various different hard drives.

2. The power source connector assembly as claimed in claim 1, wherein the power source connector holder includes a plurality of connecting legs; further comprising a soft wire including a plurality of holes for receiving the connecting legs.

3. The power source connector assembly as claimed in claim 1, further comprising a printed circuit board component disposed between the connector supporting element and the fixing piece.

4. The power source connector assembly as claimed in claim 3, further comprising an insulating piece disposed between the printed circuit board component and the fixing piece.

5. The power source connector assembly as claimed in claim 3, wherein the printed circuit board includes a plurality of connecting pins; further comprising a protecting cover for protecting the connecting pins.

* * * * *